United States Patent [19]

Brown

[11] 4,013,849

[45] Mar. 22, 1977

[54] POWER PACK PLUG SWITCH

[75] Inventor: Vincent B. Brown, Prospect Heights, Ill.

[73] Assignee: Methode Electronics, Inc., Chicago, Ill.

[22] Filed: Feb. 18, 1975

[21] Appl. No.: 550,867

[52] U.S. Cl. ..... 200/51.09; 200/16 C

[51] Int. Cl.[2] ..... H01R 33/30; H01R 33/54

[58] Field of Search ..... 200/51 R, 51.07, 51.08, 200/51.09, 51.1, 16 C, 16 D; 320/2

[56] References Cited

UNITED STATES PATENTS

| | | | |
|---|---|---|---|
| 2,229,729 | 1/1941 | Emde | 200/51 R |
| 2,453,498 | 11/1948 | Crowely | 200/16 D |
| 2,656,425 | 10/1953 | Satinoff | 200/51 R |
| 2,813,265 | 11/1957 | Finks | 320/2 |
| 3,120,632 | 2/1964 | Hopt et al. | 320/2 |
| 3,328,540 | 6/1967 | Zoda et al. | 200/16 D |
| 3,391,262 | 7/1968 | Twitchell, Jr. | 200/51.09 |
| 3,500,003 | 3/1970 | Schink | 200/16 C |

*Primary Examiner*—David Smith, Jr.
*Attorney, Agent, or Firm*—Charles F. Pigott, Jr.

[57] ABSTRACT

The plug-switch includes a pair of terminal blades projecting outwardly of a housing for insertion in an electrical socket, and first and second pairs of contacts. A carrier member, which is movable within the housing between first and second positions, is normally biased to its first position by spring means and is movable from its first position to its second position by engagement with a member associated with an electrical socket. A pair of contact members, which are carried by the carrier member, serve to bridge either the terminal blades and one pair of the contacts or the terminal blades and the other pair of the contacts.

8 Claims, 12 Drawing Figures

POWER PACK PLUG SWITCH

FIELD OF THE INVENTION

Many different types of portable or mobile power tools are provided with a battery or power pack which furnishes 6–9 volts electric power. Periodically, the power pack must be disconnected from the power tool and connected to an external 110-volt electric power source for recharging.

The present invention is concerned with a plug-switch incorporated in a power pack adapted to be removably mounted in a power tool.

SUMMARY OF THE INVENTION

The plug-switch of the present invention normally conditions the power pack for charging which is effected when the plug-switch is inserted in a conventional 110-volt electrical socket. The plug-switch automatically conditions the power pack for powering the power tool when the plug-switch is inserted in an electrical socket of the power tool.

More specifically, the plug-switch comprises first and second terminal blades secured in a housing and projecting outwardly at one end thereof for insertion in an electrical socket. A first pair of contacts are secured in the housing and are adapted to be connected to the charging side of the power pack, and a second pair of contacts are secured in the housing and are adapted to be connected to the output side of the power pack. A carrier member is slidable in the housing between first and second positions, and is normally biased to its first position by spring means. The carrier member, which carries first and second contact members, is moved from its first position to its second position by engagement with a member associated with an electrical socket of the power tool. When the carrier member is in its first position, the first contact member bridges the first terminal blade and one of the first pair of contacts, and the second contact member bridges the second terminal blade and the other of the first pair of contacts. When the carrier member is in its second position, the first contact member bridges the first terminal blade and one of the second pair of contacts, and the second contact member bridges the second terminal blade and the other of the second pair of contacts.

DESCRIPTION OF THE PREFERRED EMBODIMENT

Figure 1:
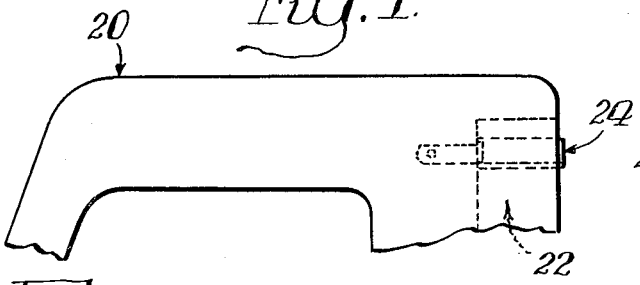
FIG. 1 is a partial side elevational view of a power tool handle and shows the plug-switch of the present invention.

Referring now to FIG. 1, there is shown a portion of a power tool handle 20 in which is removably mounted a rechargeable battery or power pack 22 having incorporated therein a plug-switch 24 embodying the principles of the present invention.

Figure 2:
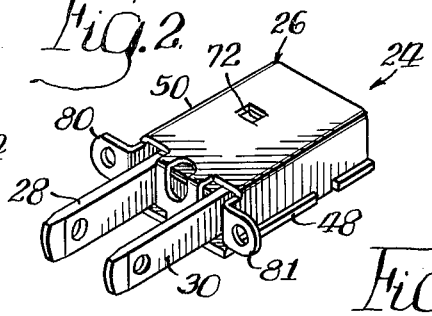
FIG. 2 is a perspective view of the plug-switch of the present invention.
Figure 3:
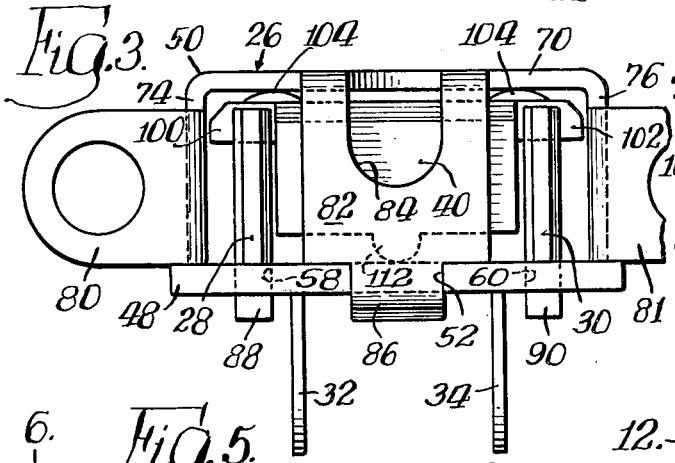
FIG. 3 is a front elevational view of the plug-switch.
Figure 4:
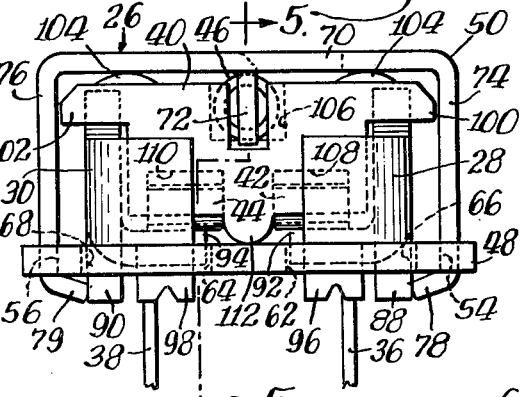
FIG. 4 is a rear elevational view of the plug-switch.

As shown in FIGS. 2–4, the plug-switch 24 comprises a housing 26, a pair of metal terminal blades 28 and 30, a second pair of terminal blades 32 and 34, a third pair of terminal blades 36 and 38, a carrier member 40, a pair of elongated 42 and 44, and a coil spring 46.

The housing 26 includes an insulator base 48 and a metal casing 50. The insulator base 48 is formed with a front recess 52, a pair of side recesses 54 and 56, a first pair of apertures 58 and 60 adjacent the front end thereof, a second pair of apertures 62 and 64 intermediate of the ends thereof, and a third pair of apertures 66 and 68 adjacent the rear end thereof. The casing 50 has a top wall 70 with an inwardly directed ear portion 72, side walls 74 and 76 with arm portions 78 and 79 and lateral front mounting flange portions 80 and 81, and a central front wall section 82 spaced from the side walls 74 and 76. The front wall section 82 is provided with a slot 84 and an arm portion 86. The casing arm portions 86, 78 and 79 are received in the base recesses 52, 54 and 56 and bent under the base 48 whereby the casing 50 is secured to the base 48.

The terminal blades 28 and 30 are provided with intermediate tongues 88 and 90 disposed in the base apertures 58 and 60, intermediate lateral contact portions 92 and 94 received in the base apertures 62 and 64, and rear tongues 96 and 98 disposed in the base apertures 66 and 68. The front ends of the terminal blades 28 and 30 project outwardly of the housing 26 through the spaces at the sides of the casing front wall section 82. The second and third pairs of terminal blades 32, 34, 36 and 38, each include a terminal contact portion which is suitably secured in the insulator base 48 on opposite sides of the terminal blade contact portions 92 and 94.

The carrier member 40, fabricated of a non-conductive material, is formed with upper side flanges 100 and 102, top bearing projections 104, an upper lengthwise recess 106, a pair of lower lengthwise recesses 108 and 110, and a bottom central lengthwise bearing ridge 112. The carrier member 40 is slidable within the housing 26 between first and second positions shown for example in FIGS. 5 and 7. The carrier flanges 100 and 102 are engageable with the casing side walls 74 and 76, the carrier projections 104 are engageable with the casing top wall 70, and the carrier ridge 112 is engageable with the base 48, for positioning and guiding movement of the carrier member 40. The carrier member 40 is normally biased to its first position by means of the spring 46 which is disposed in the carrier recess 106 and bears against the casing ear portion 72. Carried within the carrier recesses 108 and 110 are the contact members 42 and 44 in the form of generally C-shaped leaf springs.

The plug-switch 24 is secured in the power pack 22 by means of the mounting flange portions 80 and 81, the terminal blades 32 and 34 are connected to the 110-volt charging side of the pack, and the contacts 36 and 38 are connected to the 6-9 volt output side of the pack.

Figure 5:
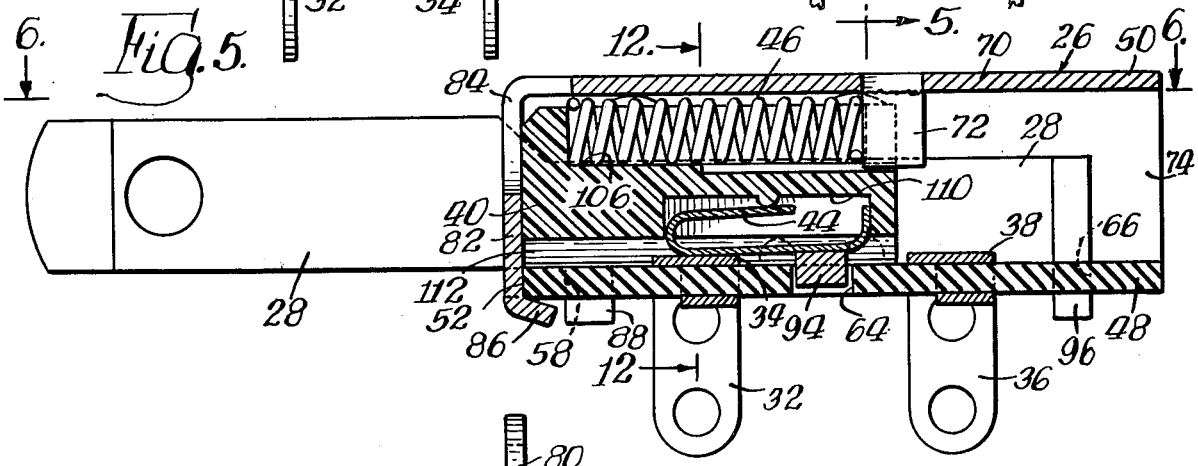
FIG. 5 is a sectional view taken substantially along the line 5—5 in FIG. 4 looking in the direction indicated by the arrows.
Figure 6:
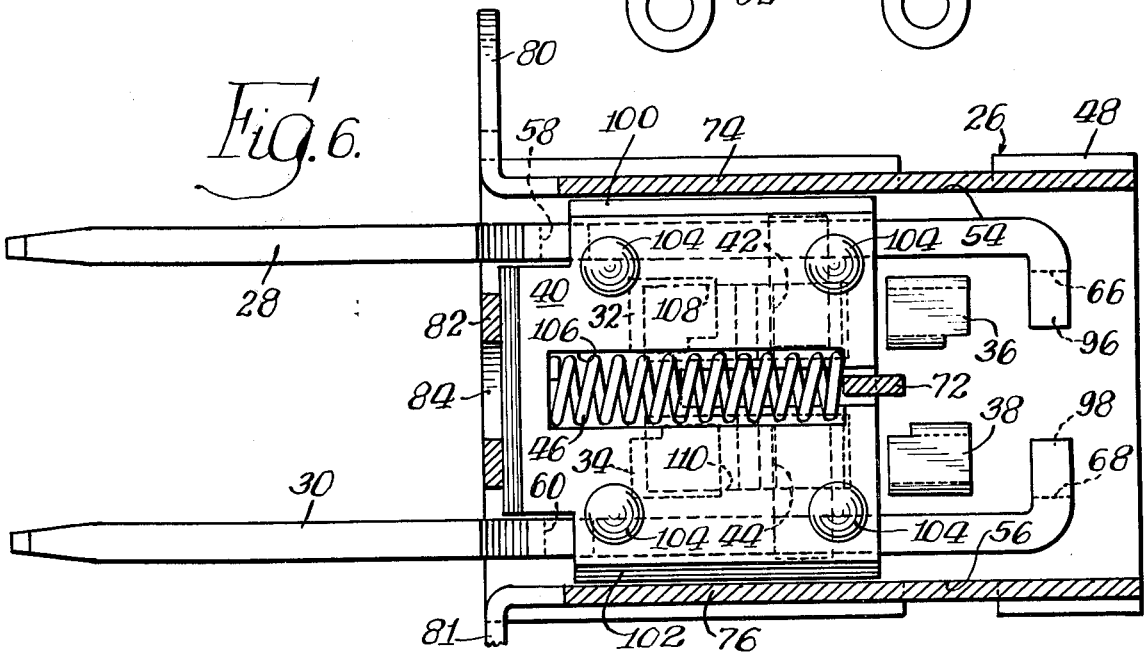
FIG. 6 is a sectional view taken substantially along the line 6—6 in FIG. 5 looking in the direction indicated by the arrows.
Figure 12:
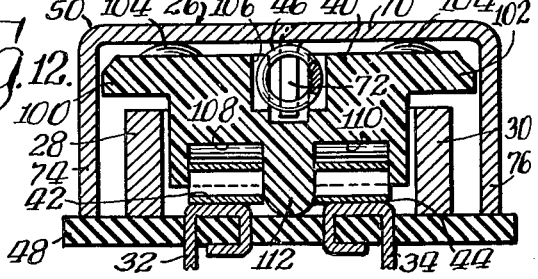
FIG. 12 is a sectional view taken substantially along the line 12—12 in FIG. 5 looking in the direction indicated by the arrows.

When the power pack 22 is removed from the power tool handle 20, the spring 46 disposes and maintains the carrier member 40 in its first position shown for example in FIGS. 5, 6 and 12. With the carrier member 40 in its first position, the first contact member 42 bridges the contact portion 92 of the terminal blade 28 and the the contact portion of terminal blade 32, while the contact member 44 bridges the contact portion 94 of the terminal blade 30 and the the contact portion of terminal blade 34. Hence, the plug-switch 24 conditions the power pack 22 for charging which is effected when the terminal blades 28 and 30 are inserted in a conventional external 110-volt electrical socket.

Figure 7:
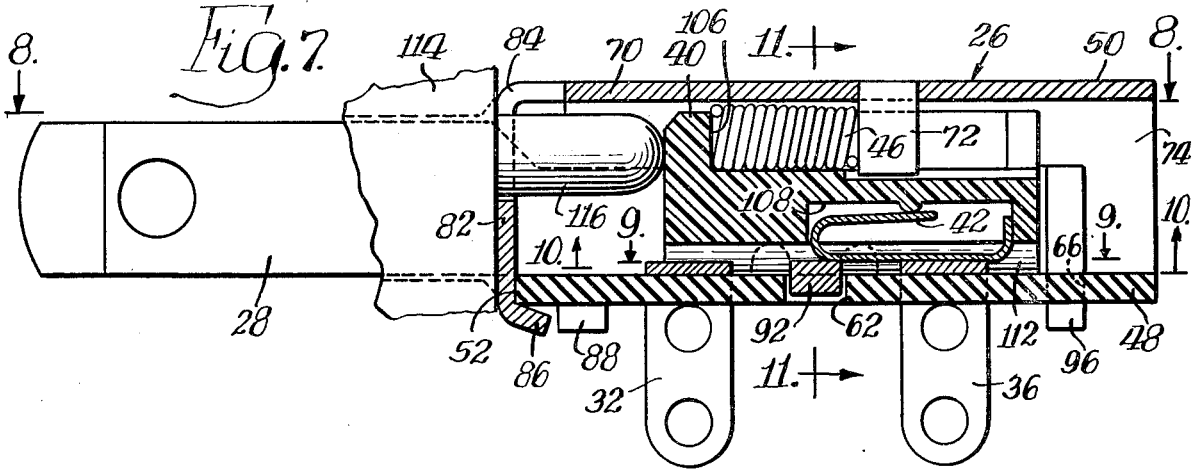
FIG. 7 is a sectional view corresponding generally to FIG. 5 but shows certain components of the plug-switch in a changed operating position.
Figure 8:
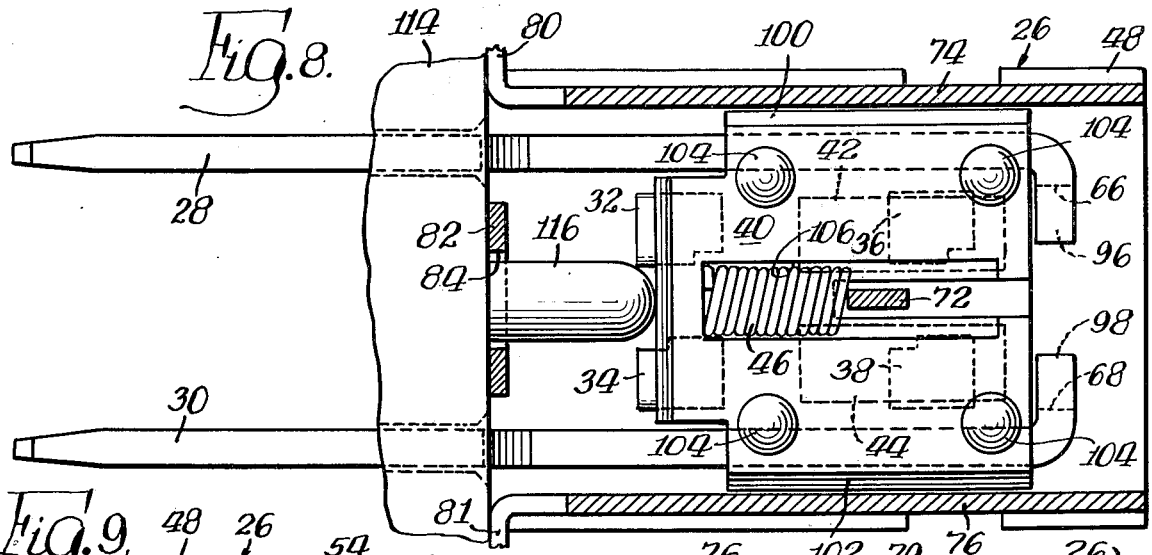
FIG. 8 is a sectional view taken substantially along the line 8—8 in FIG. 7 looking in the direction indicated by the arrows.
Figure 9:
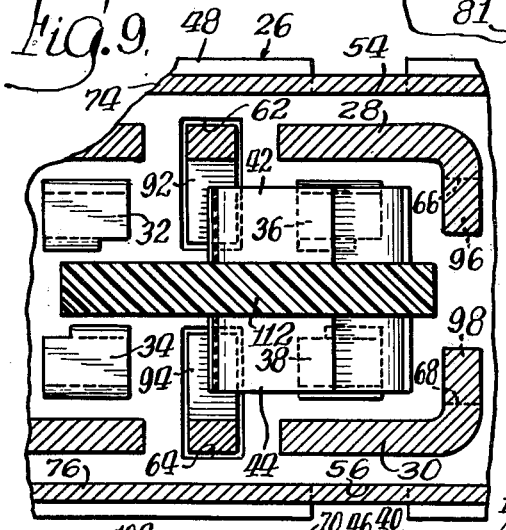
FIG. 9 is a sectional view taken substantially along the line 9—9 in FIG. 7 looking in the direction indicated by the arrows.
Figure 10:
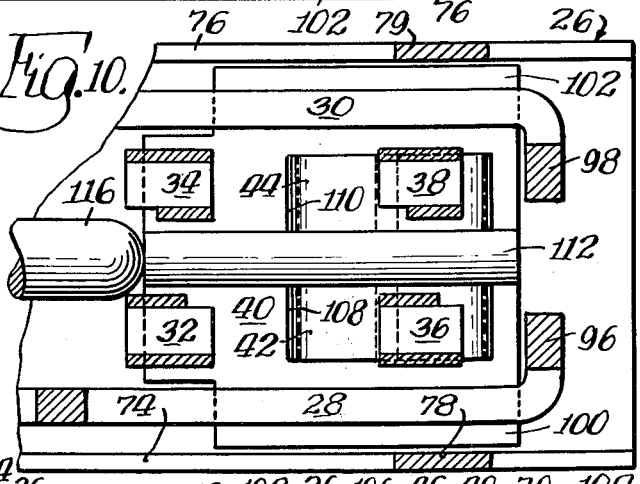
FIG. 10 is a sectional view taken substantially along the line 10—10 in FIG. 7 looking in the direction indicated by the arrows.
Figure 11:
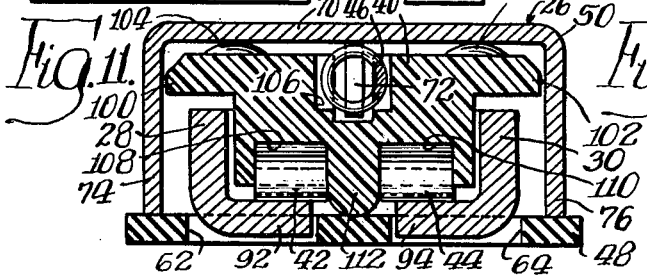
FIG. 11 is a sectional view taken substantially along the line 11—11 in FIG. 7 looking in the direction indicated by the arrows.

As shown for example in FIGS. 7 and 8, the power tool handle 20 has incorporated therein an electrical socket 114 with which is associated a projection 116. When the terminal blades 28 and 30 are inserted in the electrical socket 114, the projection 116 is received through the casing slot 84, and engages and moves the carrier member 40 from its first position to its second position shown for example in FIGS. 7 and 8. With the carrier member in its second position, the contact member 42 bridges the contact portion 92 of the terminal blade 28 and the the contact portion of terminal blade 36, while the contact member 44 bridges the contact portion 94 of the terminal blade 30 and the the contact portion of terminal blade 38. When the plug-switch 24 is thus mounted in the power tool handle 20, the plug-switch 24 automatically conditions the power pack 22 for powering the power tool.

While there has been shown and described a preferred embodiment of the present invention, it will be understood by those skilled in the art that various rearrangements and modifications may be made therein without departing from the spirit and scope of the invention

The invention claimed is:

1. A plug switch for a rechargeable power pack comprising a housing, a first pair of terminal blades secured in said housing and projecting outwardly at one end thereof for insertion in an electrical socket; a carrier member slidable in said housing between first and second positions; spring means normally biasing said carrier member to said first position, an opening formed into said housing at said one end in direct communication with said carrier member for permitting engagement of said carrier member with a member associated with an electrical socket; first and second elongated contact members carried by said carrier member; each of said first pair of terminal blades having a terminal contact portion with one contact portion in continuous sliding engagement with said first elongated contact member and with the other contact portion in continuous sliding engagement with said second elongated contact portion; a second pair of terminal blades secured in said housing and projecting outwardly from one side thereof; each of said second pair of terminal blades having a contact member disposed in the path of travel of said carrier member such that said first and second elongated contact members are brought into electrical engagement, respectively, with one and the other contact members of said second pair of terminal blades upon said carrier being moved to said first position; a third pair of terminal blades secured in said housing and projecting outwardly from said one side; each of said third pair of terminal blades having a contact member disposed in the path of travel of said carrier member such that said first and second elongated contact members are brought into electrical engagement, respectively, with one and the other contact members of said third pair of terminal blades upon said carrier being moved to said second position.

2. The plug-switch of claim 1 wherein said housing comprises a base, and a casing secured to said base and having a top wall and side walls; and wherein said carrier member is positioned and guided by engagement with said base and said casing top and side walls.

3. The plug-switch of claim 2 wherein said carrier member is formed with side flanges engageable with said casing side walls, top projections engageable with said casing top wall, and a bottom ridge engageable with said base.

4. The plug-switch of claim 1 wherein said carrier member is formed with a pair of lengthwise recesses in which said contact members are carried.

5. The plug-switch of claim 1 wherein said housing is formed with an inwardly directed ear portion, wherein said carrier member is formed with a lengthwise recess, and wherein said spring means is in the form of a coil spring disposed in said carrier recess and bearing against said housing ear portion.

6. The plug switch of claim 1, wherein said housing includes a base formed with a first pair of apertures adjacent said one end, a second pair of apertures intermediate of the ends thereof, and a third pair of apertures adjacent the other end thereof; and wherein said first pair of terminal blades are provided with intermediate tongues disposed in said first pair of base apertures, with said terminal contact portions received in said second pair of base apertures, and rear tongues disposed in said third pair of base apertures.

7. The plug switch of claim 1, wherein said housing comprises an insulator base formed with a front recess and a pair of side recesses, a casing having a top wall, side walls with arm portions, a central front wall section with an arm portion and spaced from said side walls; wherein said casing arm portions are received in said base recesses and bent under said base for securing said casing to said base; and wherein said contact members of said second and third pairs of terminal blades are secured to said base on opposite sides of said contact portions of said first pair of terminal blades.

8. The plug switch of claim 7 wherein said carrier is formed with side flanges engageable with said casing side walls, top projections engageable with said casing top wall, and a bottom ridge engageable with said base, for positioning and guiding movement of said carrier member; wherein said carrier member is formed with a pair of lower lengthwise recesses; and wherein said elongated contact members are in the form of generally C-shaped leaf springs disposed in said carrier recesses.

* * * * *